US005407106A

United States Patent [19]

Jens

[11] Patent Number: 5,407,106

[45] Date of Patent: Apr. 18, 1995

[54] AUTOMATIC/MANUAL SEALANT DISPERSER WITH ATTACHABLE HANDLE AND REVERSIBLE VALVE SEAT

[75] Inventor: Michael J. Jens, Plymouth, Minn.

[73] Assignee: Graco Inc., Minneapolis, Minn.

[21] Appl. No.: 130,591

[22] Filed: Oct. 1, 1993

[51] Int. Cl.[6] ..... B67D 3/00

[52] U.S. Cl. ..... 222/504; 222/559

[58] Field of Search ..... 222/504, 334, 389, 559, 222/465.1, 470

[56] References Cited

U.S. PATENT DOCUMENTS

| | | | |
|---|---|---|---|
| 1,007,667 | 11/1911 | Ballard . | |
| 1,430,533 | 10/1922 | Brown . | |
| 1,800,451 | 4/1931 | Jenkins . | |
| 3,463,363 | 8/1969 | Zelna | 222/504 |
| 4,178,133 | 12/1979 | Rawicki | 417/63 |
| 4,325,513 | 4/1982 | Smith et al. | 239/112 |
| 4,678,100 | 7/1987 | Gelinas et al. | 222/504 X |
| 4,867,346 | 9/1989 | Faye et al. | 222/504 X |
| 4,955,544 | 9/1990 | Kopp | 239/304 |
| 4,988,015 | 1/1991 | Price | 222/504 X |
| 4,993,645 | 2/1991 | Buschor | 239/708 |

*Primary Examiner*—Kevin P. Shaver

*Attorney, Agent, or Firm*—Douglas B. Farrow

[57] ABSTRACT

The dispense valve is designed for application of high viscosity fluids and is designed so that it is equally effective and usable in manual or automatic versions. The valve is air operated and the air section and fluid sections may be swiveled relative to one another to allow the inlet lines to be aligned in the desired manner relative to one another. The seat against which the needle seals is designed to be reversible to effectively double the life of the single part. Also, the trigger valve attaches directly to the valve itself so as to allow ease of attachment and detachment. The complete assembly provides a compact, easily maneuverable and effective device.

2 Claims, 5 Drawing Sheets

FIG. 3

AUTOMATIC/MANUAL SEALANT DISPERSER WITH ATTACHABLE HANDLE AND REVERSIBLE VALVE SEAT

BACKGROUND OF THE INVENTION

Dispensing valves for high viscosity fluids (up to 600,000 centipoise) such as sealants and adhesives are of course well known. Such valves typically have an air operated cylinder which controls a fluid valve. Such valves have often been awkward to use because of the need to plumb both fluid and air lines directly to the valve. Such valves have also typically been designed for either manual or automatic operation and any attempts to adapt one valve to the other purpose has been less than satisfactory.

SUMMARY OF THE INVENTION

It is therefore an object of the invention to provide a dispense valve which allows the air and fluid hoses to be easily aligned as desired by the operator and in which changes may be easily and expeditiously accomplished. It is further an object of this invention to provide a device which provides extended wear and it is also an object of this device to provide a unit which is equally suitable for manual and automatic operation.

The dispense valve of the instant invention is comprised generally of an air operated valve and a fluid valve with the two valves being connected together by a swivel nut which is desirably attached to the fluid valve. Loosening of the swivel nut allows the rotational position along the axis of the gun to be varied between the two valves so as to allow the desired alignment between respective fluid and air inlet hoses on those components.

The valve seat is contained between a needle nozzle housing and the aforementioned valve housing, the seat being symmetrically designed in its axial direction so that it may be reversed to provide two complete and separate wear surfaces so as to effectively double the life of the seat.

For manual operation, the air trigger valve attaches directly to the air operated valve while the handle slips over the air operated valve and provides a slot to allow the trigger valve to extend forwardly where it may be actuated by the operator.

These and other objects and advantages of the invention will appear more fully from the following description made in conjunction with the accompanying drawings wherein like reference characters refer to the same or similar parts throughout the several views. dr

A BRIEF DESCRIPTION OF THE DRAWINGS

DESCRIPTION OF THE PREFERRED EMBODIMENT

Figure 1:
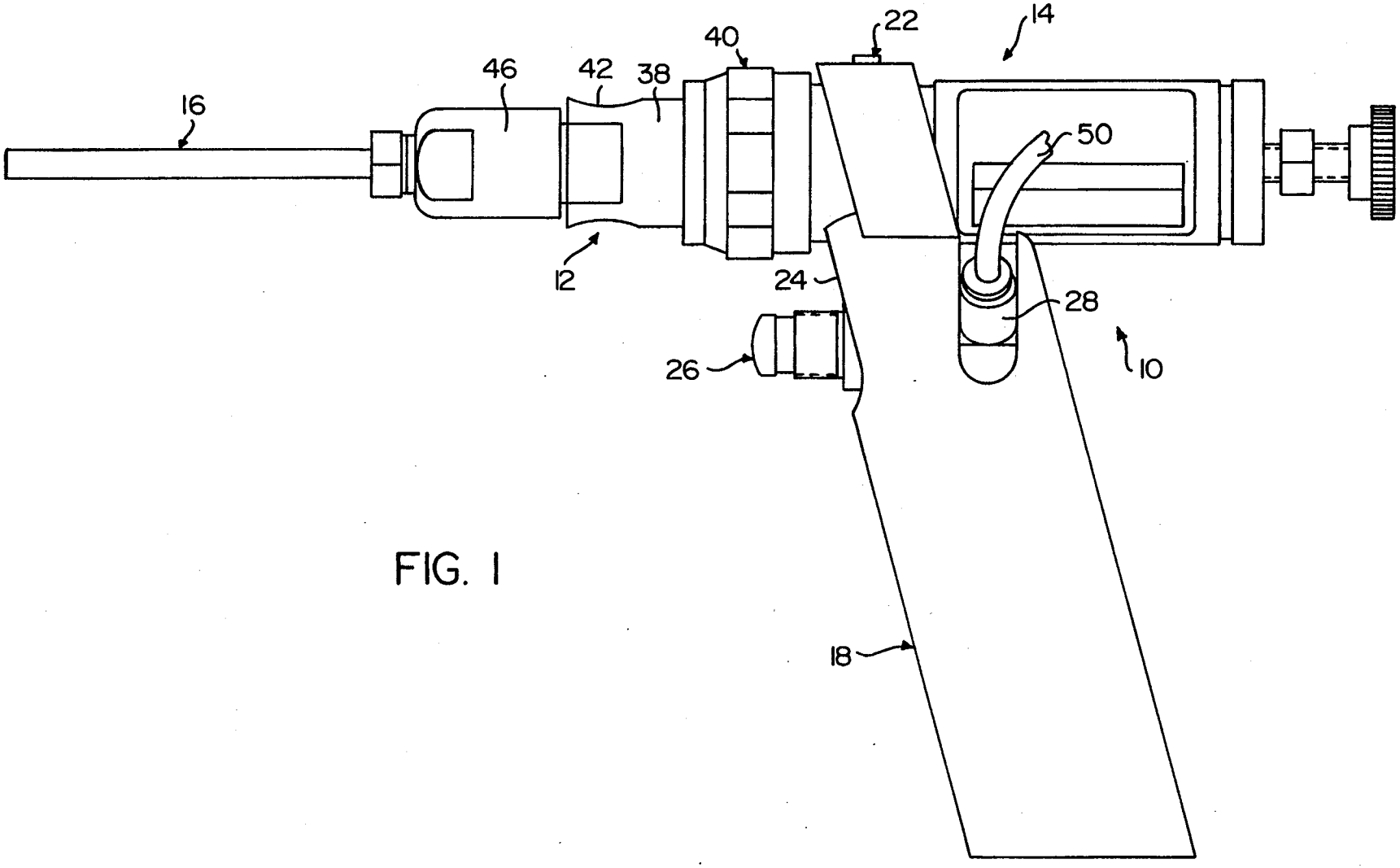
FIG. 1 is a side plan view of a manual dispense valve according to the instant invention.
Figure 2:
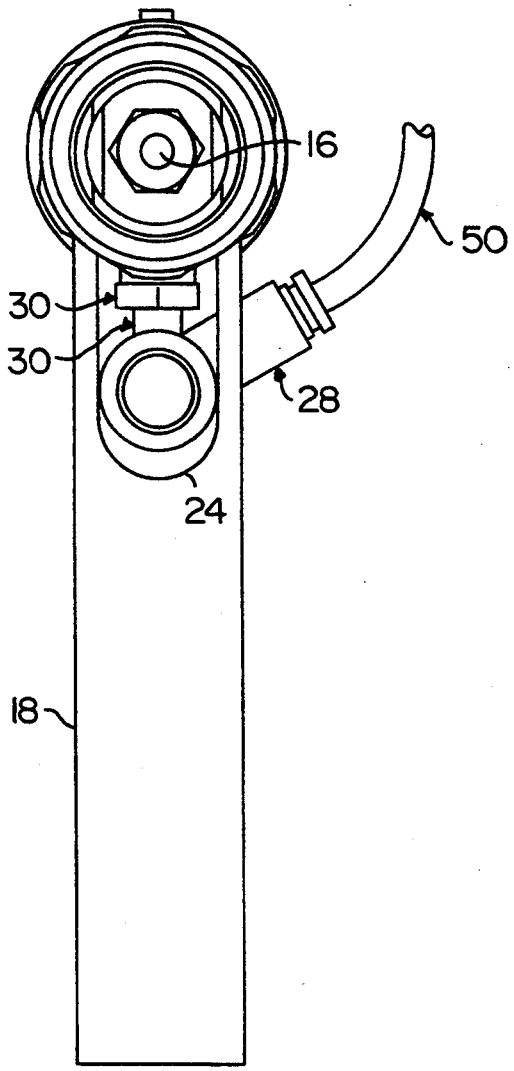
FIG. 2 is a front view of the valve shown in FIG. 1.

Turning to FIG. 1, the device of the instant invention, generally designated (10), is comprised of a fluid valve (12), an air operated valve, (14) a nozzle (16) and a handle (18).

Figure 3:
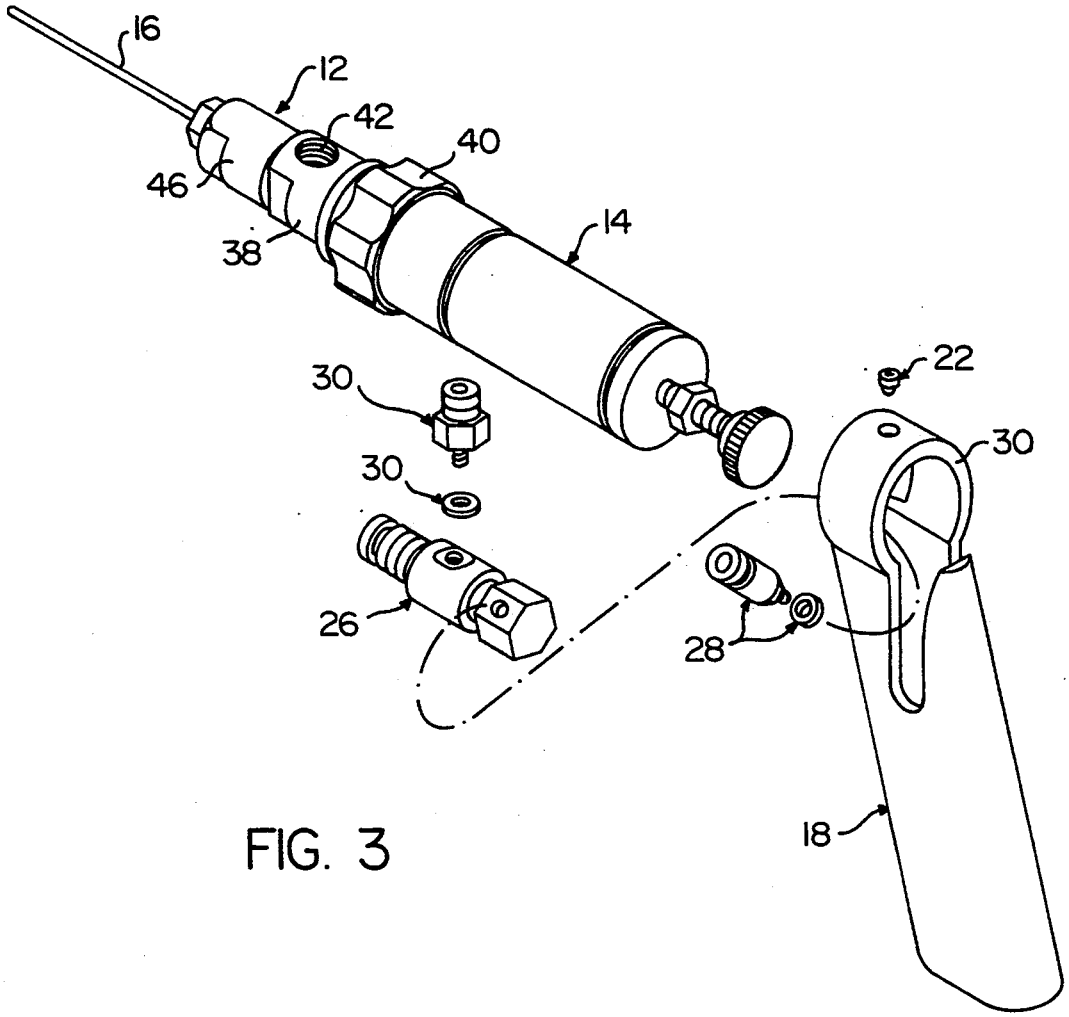
FIG. 3 is a partially exploded view of the valve of FIG. 1.

The attachment of the handle mechanism (18) is shown in more detail in FIG. 3. Handle (18) has an open loop top (20) which has a set screw (22) therein which fixes to the top of air operated valve (14). A slot (24) in the front of handle (18) allows a trigger valve (26) to extend outwardly whereby it may be actuated by the operator. Trigger valve (26) has an air inlet (28) and an air outlet (30) which in turn screws into the bottom side of air operated valve (14).

Figure 4:
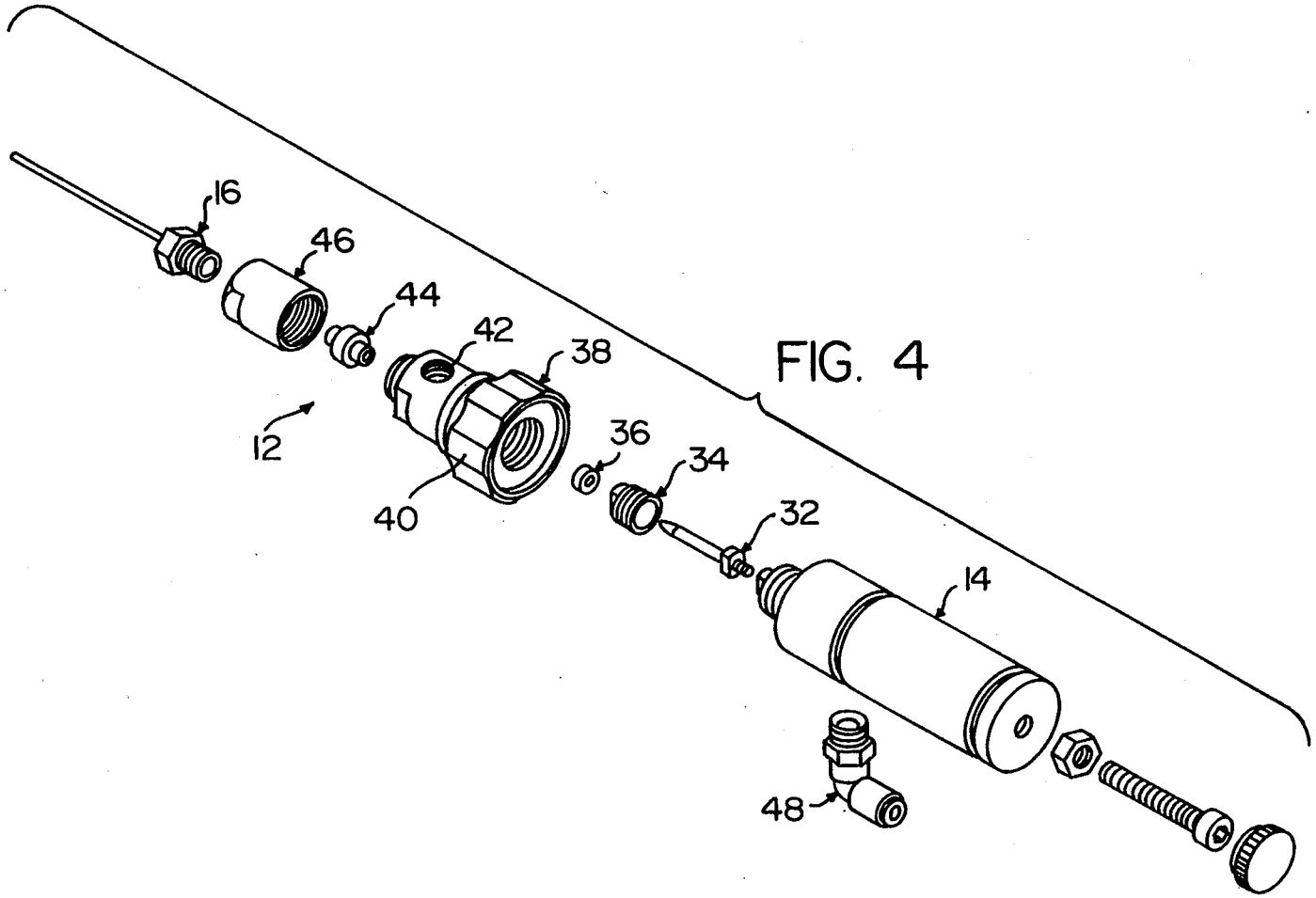
FIG. 4 is an exploded view of an automatic version of the instant invention showing more detail of the fluid section.
Figure 5:
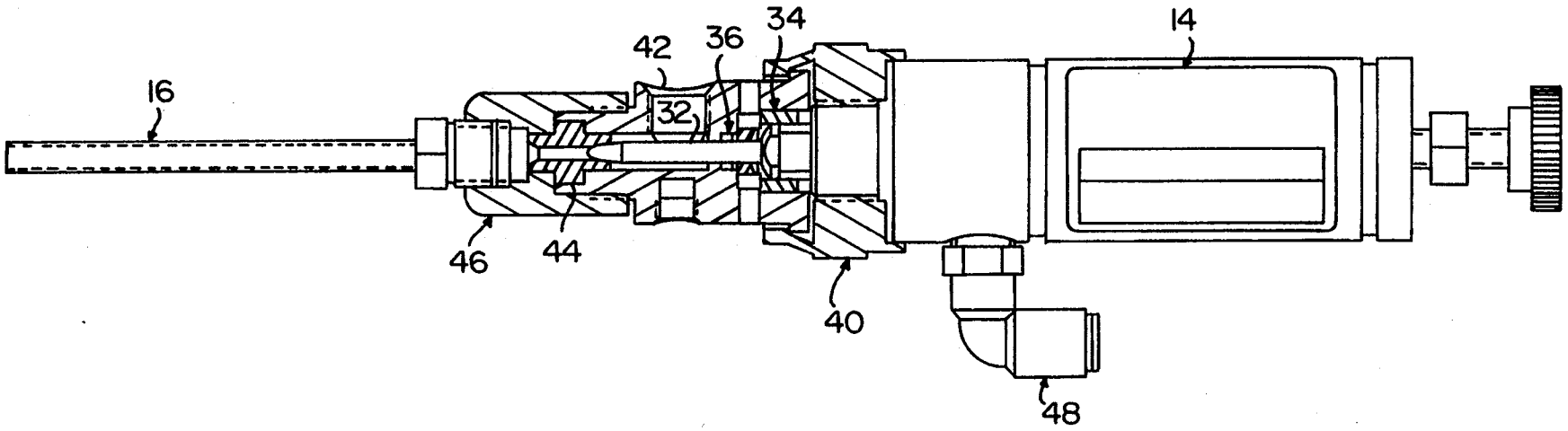
FIG. 5 is a partial cross-section view of the automatic gun shown in FIG. 4.

The fluid arrangement of the device of the instant invention is shown in more detail in FIGS. 4 and 5. In particular, a needle (32) extends forwardly from air operated valve (14). A packing retainer (34) retains packing (36) in valve housing (38). Valve housing (38) threadedly attaches to the air operated cylinder (14) and may be positioned relative thereto by tightening of swivel nut (40).

A fluid inlet (42) is provided in one side of valve housing (38) such that fluid entering therein is controlled by the seating of needle (32) against reversible seat (44) which is confined between valve housing (38) and nozzle housing (46). As can be seen from FIGS. 4 and 5, seat (46) is symmetrical in the axial direction thereby allowing it to be reversed for increased life. Nozzle (16) is attached to the front of nozzle housing (46).

In the automatic version shown in FIGS. 4 and 5, an air inlet fitting (48) may be connected to air line (50) which connects to trigger inlet (28) in the manual version.

As can be seen in FIGS. 4 and 5 (as well as the other Figures to a certain extent) to position fluid and air inlets (42 and 48) respectively, all one need do is loosen swivel nut (40) and rotate valve housing (38) relative to air operated valve (14) and then re-tighten. As can be seen in FIG. 3, handle (18) may be easily removed by merely loosening set screw (22) and removing air inlet fitting (28).

It is contemplated that various changes and modifications may be made to the dispense valve without departing from the spirit and scope of the invention as defined by the following claims.

What is claimed is:

1. A fluid application device comprising:

a fluid valve having a generally longitudinal axis and a fluid inlet in one side thereof and extending generally radially outwardly therefrom; and an air operated valve having an air inlet in one side thereof controlling said fluid valve, the improvement comprising:

means connecting said fluid valve and said air operated valve allowing said valves to swivel relative to one another so as to allow operator positioning of said fluid inlet; and a handle removably attached to said air operated valve, said handle comprising a trigger valve having a trigger inlet and a trigger outlet, said trigger outlet being removably connected to said air inlet so that said handle may be selectively removed while allowing operation of said device with and without said handle attached.

2. The fluid application device of claim 1 wherein said fluid valve comprises a needle, a seat and a cavity, said seat having first and second ends and substantially identical first and second seating surfaces on said first and second ends so as to allow said seat to be reversed in said cavity for increased life.

* * * * *